US010195480B2

(12) United States Patent
Kelly

(10) Patent No.: US 10,195,480 B2
(45) Date of Patent: Feb. 5, 2019

(54) HORIZONTAL ROWING MACHINE

(71) Applicant: Sean Kelly, Miami Beach, FL (US)

(72) Inventor: Sean Kelly, Miami Beach, FL (US)

( * ) Notice: Subject to any disclaimer, the term of this patent is extended or adjusted under 35 U.S.C. 154(b) by 234 days.

(21) Appl. No.: 15/368,119

(22) Filed: Dec. 2, 2016

(65) Prior Publication Data

US 2017/0157455 A1 Jun. 8, 2017

Related U.S. Application Data

(60) Provisional application No. 62/263,361, filed on Dec. 4, 2015.

(51) Int. Cl.

| | |
|---|---|
| ***A63B 22/00*** | (2006.01) |
| ***A63B 21/00*** | (2006.01) |
| ***A63B 21/06*** | (2006.01) |
| *A63B 21/04* | (2006.01) |
| *A63B 21/055* | (2006.01) |

(52) U.S. Cl.

CPC ..... *A63B 22/0076* (2013.01); *A63B 21/06* (2013.01); *A63B 21/4034* (2015.10); *A63B 21/4035* (2015.10); *A63B 22/0012* (2013.01); *A63B 22/0046* (2013.01); *A63B 21/00065* (2013.01); *A63B 21/0442* (2013.01); *A63B 21/0552* (2013.01); *A63B 21/4049* (2015.10); *A63B 2022/0033* (2013.01); *A63B 2022/0035* (2013.01); *A63B 2022/0038* (2013.01); *A63B 2022/0041* (2013.01); *A63B 2022/0082* (2013.01); *A63B 2208/0204* (2013.01); *A63B 2208/0233* (2013.01); *A63B 2225/09* (2013.01); *A63B 2225/093* (2013.01)

(58) Field of Classification Search

None

See application file for complete search history.

(56) References Cited

U.S. PATENT DOCUMENTS

| | | | | |
|---|---|---|---|---|
| 4,336,934 A * | 6/1982 | Hanagan | A63B 21/0615 482/73 |
| 5,554,084 A * | 9/1996 | Jones | A63B 21/0615 482/134 |
| 5,957,817 A * | 9/1999 | Koenig | A63B 21/0615 482/137 |
| 5,997,446 A * | 12/1999 | Stearns | A63B 21/00072 482/56 |
| 6,264,585 B1 * | 7/2001 | Beauchamp | A63B 21/00181 482/137 |
| 7,070,545 B2 * | 7/2006 | Lull | A63B 23/0405 482/100 |

(Continued)

*Primary Examiner* — Stephen R Crow

(74) *Attorney, Agent, or Firm* — Nasser Ashgriz; UIPatent Inc.

(57) ABSTRACT

The present invention is a horizontal rowing machine having a frame with a removable seat, adjustably mounted on the frame and an adjustable chest pad. The present invention has angled foot plates. The foot plates enable the user to use the machine in various positions. The present invention has two fixed multi-grip handles with 8 fixed hand positions and 6 positions on which to attach swivel handles. The swivel handles allow for a more natural and free form rowing movement. Maximal adjustability of all aspects of the machine allow for a more optimal and beneficial training exercise for any user, regardless of body size. The user can lift a desired weight by pulling the handles.

15 Claims, 6 Drawing Sheets

(56) References Cited

U.S. PATENT DOCUMENTS

| | | | | |
|---|---|---|---|---|
| 7,448,988 | B2 * | 11/2008 | Taylor | A63B 21/00181 482/133 |
| 7,766,802 | B2 * | 8/2010 | Webber | A63B 21/159 482/100 |
| 8,568,279 | B2 * | 10/2013 | Golesh | A63B 21/0728 482/104 |
| 8,944,969 | B2 * | 2/2015 | Giannelli | A63B 23/12 482/51 |
| 2017/0157455 | A1 * | 6/2017 | Kelly | A63B 21/4034 |

* cited by examiner

HORIZONTAL ROWING MACHINE

RELATED APPLICATION

This application claims the benefit of U.S. Provisional Patent Application No. 62/263,361 filed on Dec. 4, 2015.

FIELD OF THE INVENTION

The present invention relates in general to an exercise machine and in particular to a horizontal rowing machine for strengthening muscles.

BACKGROUND OF THE INVENTION

Rowing machines are effective whole body exercise machines that can build up muscles of upper back, arms, hands, legs, torso, and various other muscle groups. This exercise uses some of the largest muscles in the body with an emphasis on the upper back and arm muscles. The rowing exercise is usually performed while sitting on a seat mounted on a rowing machine. However, the present invention allows the user to perform the exercise in various other positions, and even perform the exercise while standing. It also uses weight plates or elastic bands for added resistance.

SUMMARY OF THE INVENTION

The present invention is a horizontal unilateral rowing machine such that it would mimic natural, free form movement to the greatest degree possible. The rowing arms do not diverge, but instead they move in a perfectly parallel pattern.

The present rowing machine provides various hand grips, seating positions and foot positions. The handles, seat, chest support and foot plates are all adjustable. This adjustability allows users of any height, size or limb length to effectively use the machine. The rowing machine of the present invention allows for a variety of methods to perform the rowing exercise. One can perform the rowing exercise while standing and with or without the chest support. It also allows the user to change the machine setting to train a desired area of the body more effectively, such as training the back muscles using several different rowing angles.

Prior art rowing machines have a fixed grip. However, in the present machine, the user's grip can be change dynamically and selectively for building up the upper back, arms, hands, legs, torso or various other muscle groups. The present machine has a swivel handle, enabling the arms to move forward, backward, or slightly leftward and rightward during the rowing action. In addition, the user can change the position of the the swivel handle according to the muscles he/she is planning to train.

The present rowing machine has different types of resistances. It can be used with a set of plates, band hooks, or combination of both. Bands allow for maximal muscular contraction throughout the entire range of each repetition.

Prior art rowing machines have fixed axes of motion for the hands and legs. However, the present machine the plane or the axes of motion for the hands and legs can be different. The leg motion may not be on the same horizontal plane as the hand motion. Therefore, during the pulling action, the reaction force may not be as effectively transferred to the legs. In order to accommodate for this plane adjustment, a chest pad is provided to receive the reaction force during the pulling action and to transfer the reaction force to user's chest. This provides a comfortable rowing exercise and supports the user's upper body when it presses against it.

The chest pad is swivelly connected to the frame of the machine, therefore, its angle changes with the angle of the user's upper body during the exercise.

The present machine comprises of a main frame with a base that rests on a surface and supports all the machine components. Attached to the main frame are a removable seat that is adjustably mounted on the main frame, an adjustable chest pad, a pair of hand grips, and two pairs of foot plates. The chest pad can move forward and backward, as well as swivel up and down. The first pair of foot plates are independently mounted on the outer support beams. This allows performing the exercise from the either the right or the left side. The second pair of the foot plate are mounted on a middle support beam of the frame to enable a user to perform the exercise with both feet. The user can perform the rowing exercise with either the right or the left hand or with either the right or the left foot, or both hands and feet. The user can also operate the machine in a seated position or even in a standing position by removing the seat.

The present rowing machine further comprises of a moving portion having two fixed, unilateral hand grips with preferably 8 fixed hand grip positions and 6 spots on which the swivel handles can be mounted. The swivel handles allow for a more natural, free form rowing movement. The user's grip can easily change dynamically when the swivel handles are moved forward, backward, or slightly leftward and rightward to create the rowing action. In operation, the rowing arms of the machine do not diverge (as occurs in the traditional rowing machines), but instead they move in a perfectly parallel pattern. The weights move upward against the gravity during the pulling action, and return to their resting state once the pulling action is removed.

The handles, the seat cushion, the chest support and the foot plates are all adjustable. This adjustability allows anyone of any height, size or limb length to effectively use this machine. The machine can be used seated or standing and with or without the chest support. The grip position can also be changed. This allows having different rowing pattern for optimal results. It also allows changing the training effect and targeting the back muscles at a greater number of different angles.

In summary, the present invention is a horizontal rowing machine comprising of a frame having a right and a left longitudinally extended beams, a set of cross beams to stably support the rowing machine; a pair of lever arms, wherein the lever arms are substantially vertical at their rest position, and each the lever arm has a moveable proximal end on its upper side, a movable distal end on its lower side, and a fixed lever point in between the proximal and distal end, wherein the lever point is pivotally connected to the frame, whereby each the lever arm pivots on a single-vertical-plane; a handle attached to the proximal end of each the lever arm to be grabbed and pulled by a user, whereby the handle moves in a vertical and non-diverging plane keeping the user's hand movement in a vertical plane; and a weight plate holder attached to the distal end of each the level arm to resist a pulling action of the user.

The present invention further has an adjustable seat removably attached to the frame at a predefined longitudinal distance from the lever arms, and wherein the seat is adjustable to allow the user's arm to be substantially horizontal when grabbing each the handle; an adjustable chest pad attached to the frame and located in between the seat and the lever arms to support the user's body during the releasing action of the lever arms; and a pair of foot plates mounted with an angle to the frame to help in the pulling and releasing actions of the lever arms, whereby the user sits on the adjustable seat with user's chest against the chest pad and user's foot on the foot pads, grabs the handles performs pulling and releasing of the lever arms, mimicking a rowing action.

In the present invention, each the lever arm is a five sided concave polygon, wherein the lever point is on a first corner of the polygon, the handle is attached to a third corner of the polygon, and the weight plate holder is attached to a fifth corner of the polygon, and wherein a second corner of the polygon is located such that the first and the third corners make a concave side of the polygon, and wherein the angles of the polygon are adjusted to provide a substantially horizontal movement to the handle during a pivoting action of the lever arm around the first corner.

Therefore, it is an object of the present invention to provide a rowing machine that can be operated in a variety of methods by providing various hand grip positions and adjustable parts.

It is another object of the present invention to provide swivel handles to be connected to various positions on the handle. The swivel handles create a rowing movement in combination with the swivel chest pad that changes the angle of the user's upper body slightly during the exercise.

It is another object of the present invention to provide a horizontal rowing machine that every part of it is adjustable, to allow users with different heights and weights to adjust the device for their comfort and training preference, and change the range of movement for this exercise.

It is another object of the present invention that the user can select the position and the orientation of the handle to perform the exercise either with the right arm and the right foot to exercise the right side muscles of the body, or with the left arm and the left foot to exercise the left side muscles of the body.

Other objects, features, and advantages of the present invention will be readily appreciated from the following description. The description makes reference to the accompanying drawings, which are provided for illustration of the preferred embodiment. However, such embodiments do not represent the full scope of the invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

The figures are not intended to be exhaustive or to limit the present invention to the precise form disclosed. It should be understood that the invention can be practiced with modifications and alterations, and that the disclosed invention be limited only by the claims and equivalents thereof.

DETAILED DESCRIPTION OF PREFERRED EMBODIMENTS

Figure 1:
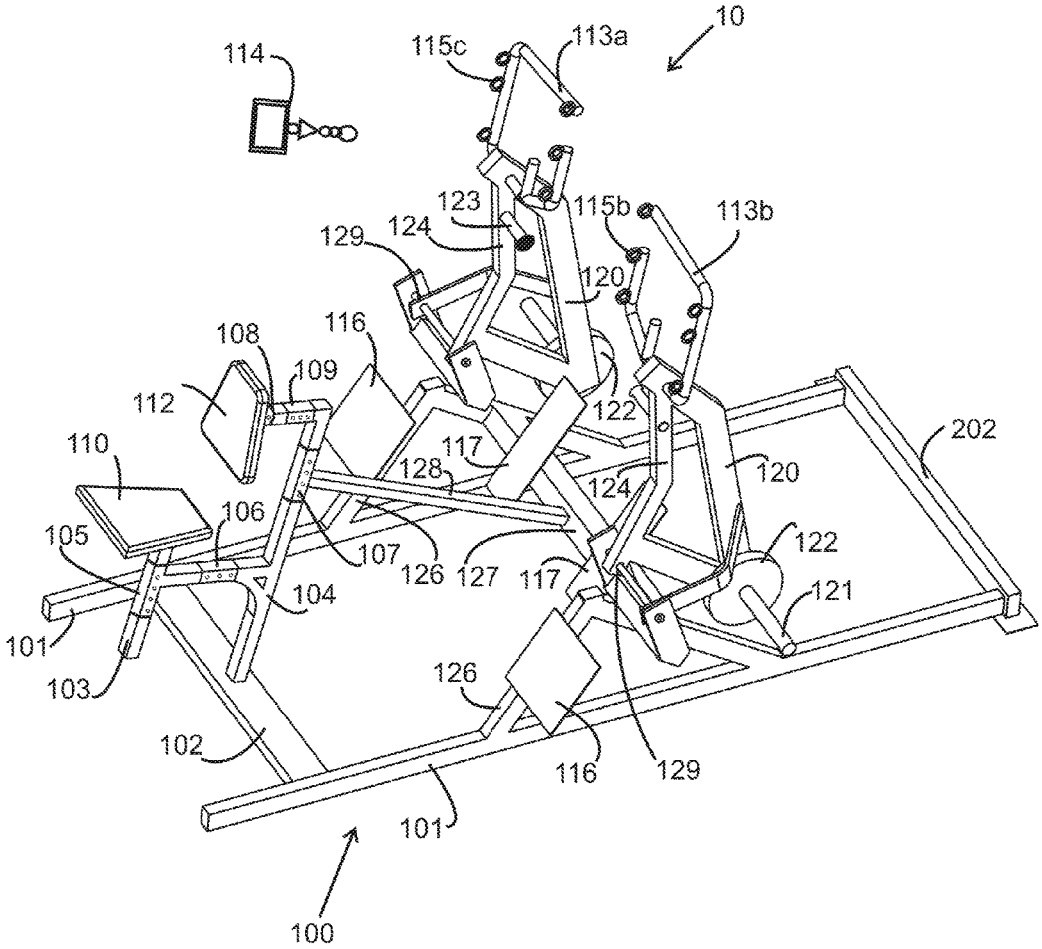
FIG. 1 is a perspective view of a horizontal rowing machine constructed according to the principles of the present invention.
Figure 2:
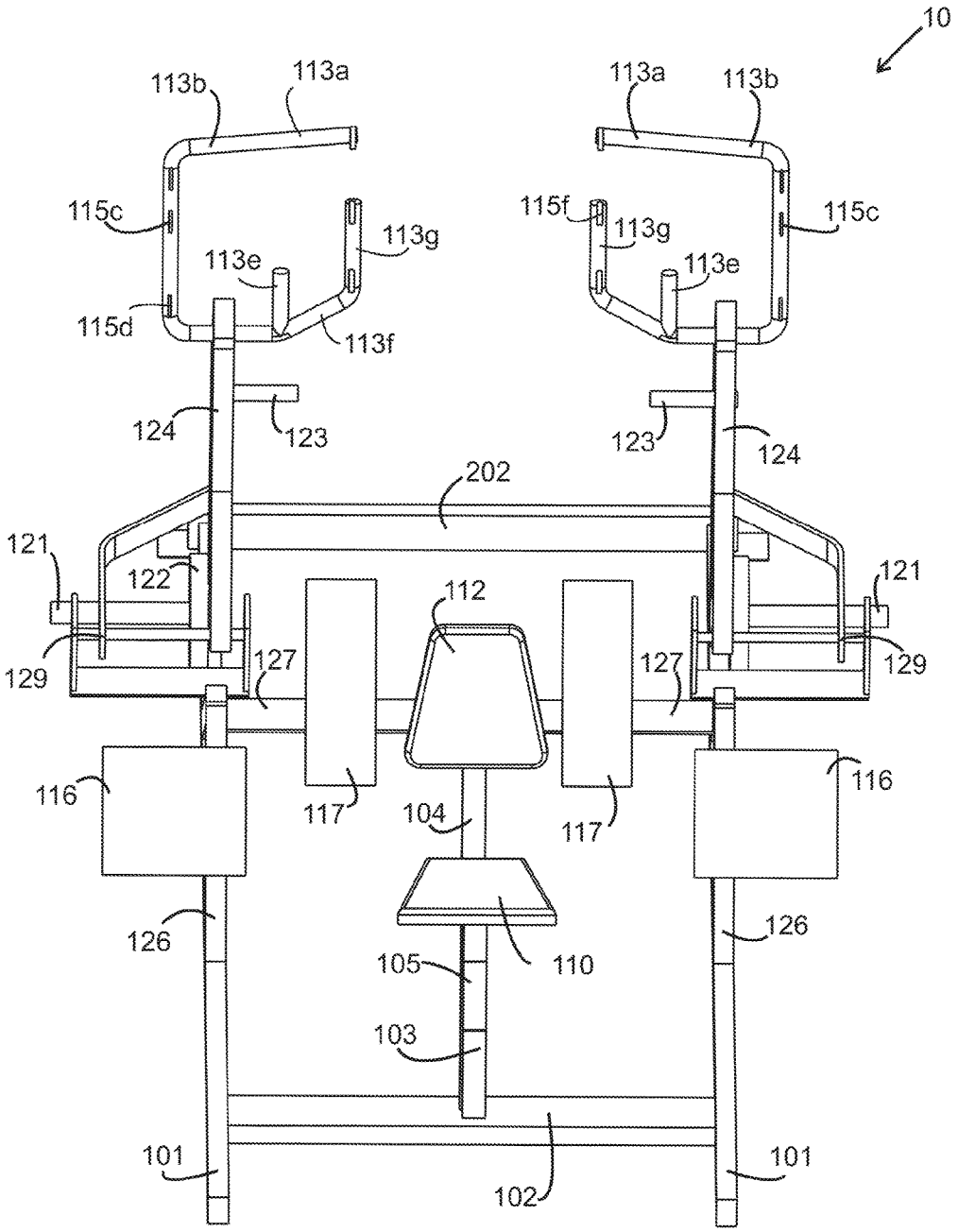
FIG. 2 is a top elevation of the horizontal rowing machine of the present invention.
Figure 3:
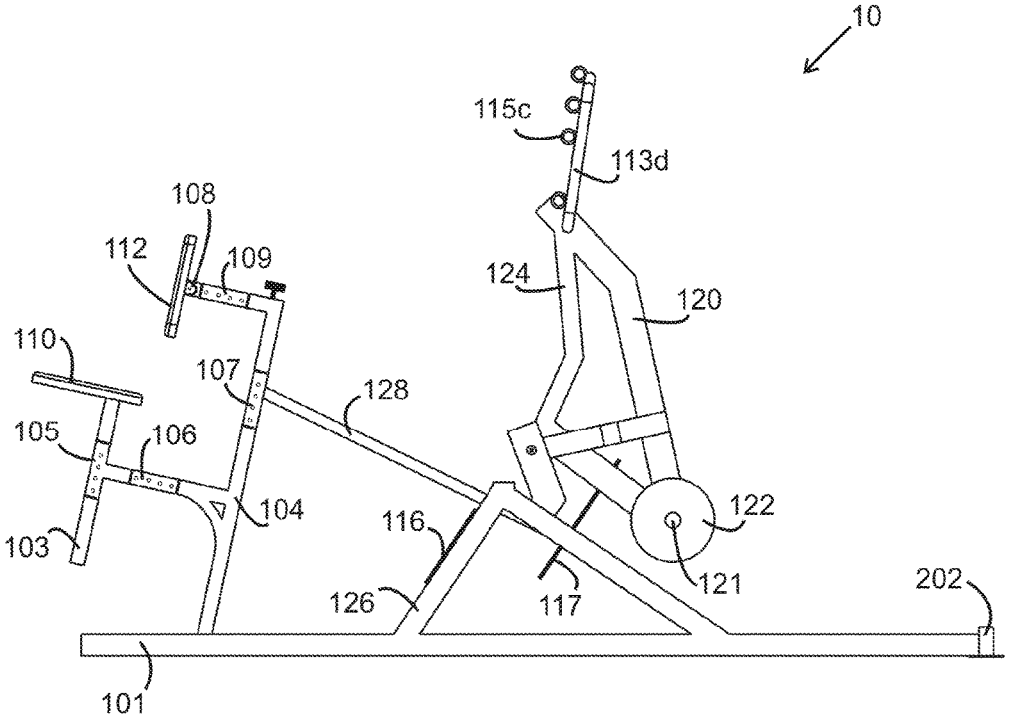
FIG. 3 is a side view of the horizontal rowing machine of the present invention.

Referring to FIGS. 1, 2 and 3, the main elements of the horizontal exercise rowing machine 10 are as follows:

A base 100 to engage with the floor. The base is sufficiently large to provide stability to the machine. In the preferred embodiment, the base 100 comprises of two longitudinally extending base supports 101, one on the right and one on the left side of the base. The base supports 101 have a plurality of cross support beams, horizontally extending between the right and the left base supports 101. The first cross support beam 102 is attached close to the front end of the base support beams 101 to support a seat 110 and a chest pad 112 of the machine. A second cross beam 202 is provided at the rear end of the base support beams 101 to provide more stability to the machine.

An adjustable seat 110 attached to a vertical seat support beam 103. The seat 110 can be adjusted upwards and downwards, according to the user's height, using pinholes 105 mounted on the vertical seat support beam 103. The vertical seat support beam 103 connects to a vertical chest support beam 104 through a cross beam 106 having pinholes mounted thereon to provide forwards and backwards adjustability to the seat. In addition, the seat 110 can be removed to operate the machine in a standing position.

An adjustable chest pad 112 to help prevent the upper body from moving forward and taking tension off of the upper back muscles. The chest pad 112 helps to create an ergonomically friendly lever, which allows an effective rowing motion. Said chest pad 112 is mounted from one end to the L shape vertical chest support beam 104 and to the horizontal support beam 102 of the main frame 100 from its other end. The L shape chest support beam 104 further has pinholes 107, 109 to adjust the chest pad 112 according to the user's height. The vertical chest support beam 104 connects to the middle support beam 127 through a cross beam 128. The chest pad further has 112 swivel means 108 to change its angle during the exercise and can be removed to operate the machine without a chest pad 112.

In a conventional rowing exercise, the reaction force during the pulling action is taken by the user's legs, which are fixed on a pair of foot pads. This is possible because the conventional rowing exercise is performed in a horizontal direction. In the present machine, the legs can be in any desired plane and not necessarily in the same horizontal plane as the hands. Therefore, during the pulling action, the reaction force may not be as effectively transferred to the legs. A chest pad 112 allows said force to be transferred to the user's chest. This provides a comfortable rowing exercise and supports user's upper body when it presses against it.

A moving portion comprising of a pair of handles (113*a*-113*h*) is attached to a pair of moving arms 120 extended to a pair of weight plate holders 121 on each side and a pair of support arms 124. Said support arms 124 are rotatable and moveable about an axis point 129 and connected to the middle support beam 127 of the frame. Generally, the two moving arms 120 move independent of each other. This allows the user to easily operate the machine 10 to exercise a muscle group on either the left or the right side of the body. Furthermore, this independent motion will insure that each arm of the user is performing the exercise, to improve the overall results and prevent a stronger arm from overly compensating for the other. In addition, the total weight being lifted is split evenly between the arms. The handles (113*a*-113*h*) are arranged in a manner to be grasped by the user and moved along a guided path resisted by the machine 10.

In order to effectively manipulate the moving arms 120, each moving arm 120 is provided with at least a handle (113*a*-113*h*) with a unique shape that provides 8 grip position and at least 6 points to connect a swivel handle 114 that the user will grip when performing the exercise. Therefore, the range of motion of various handle positions will define various upper body muscle workout when performing the exercise.

According to FIG. 3, each handle (113*a*-113*h*) is extended to a weight plate holder 121 by a support arm 120. Each weight plate holder 121 allows adding resistance to the machine. The machine 10 can be loaded with multiplicity of plates 122. In one embodiment, the device 10 can be loaded with up to eight 45 pound plates per side or per handle. Therefore, it can be used for training purposes for athletics or body building.

Figure 4:
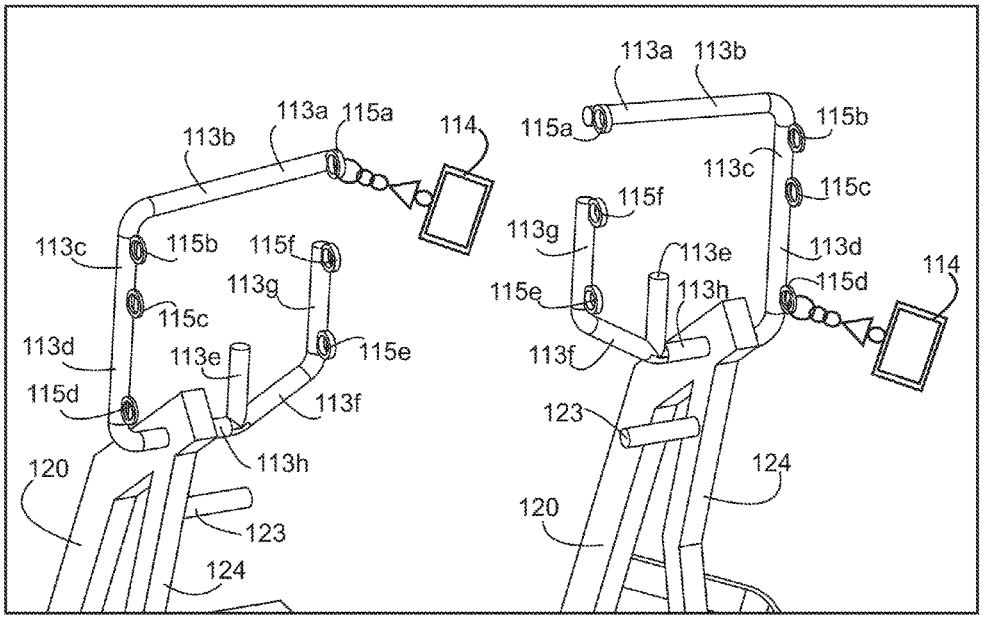
FIG. 4 is a perspective view of the handles of the present invention.
Figure 5A:
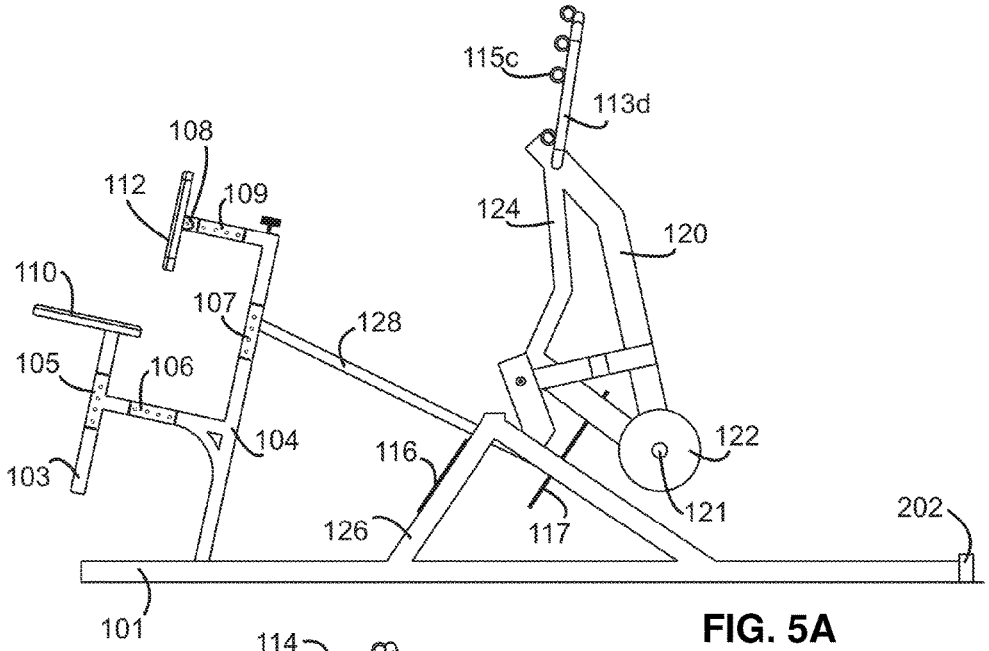
FIG. 5A is a side view of an alternative embodiment of the horizontal rowing machine constructed according to the principles of the present invention.
Figure 5B:
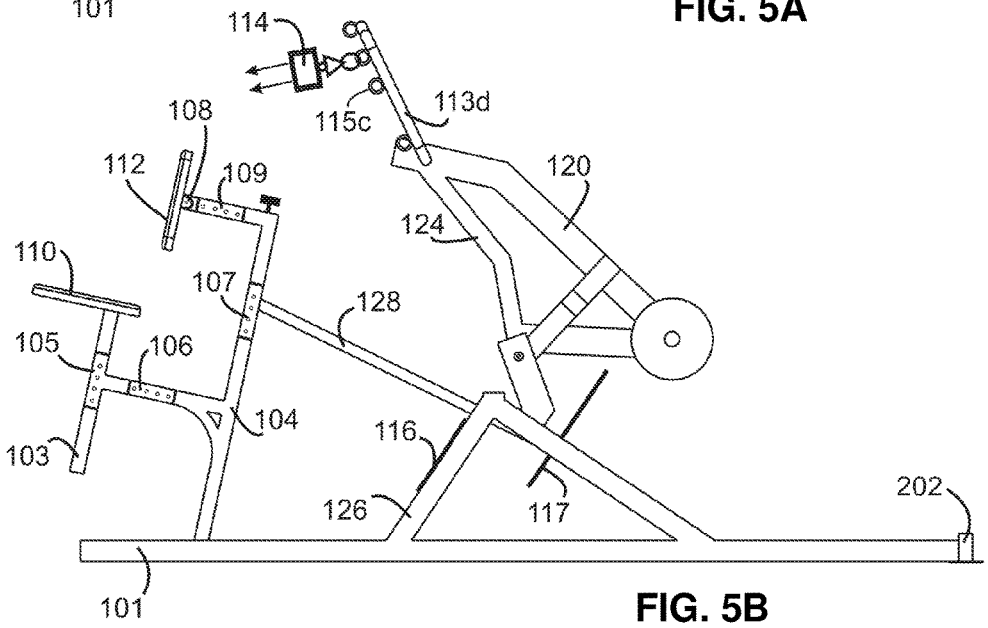
FIG. 5B is a side view of an alternative embodiment of the horizontal rowing machine constructed according to the principles of the present invention.
Figure 6A:
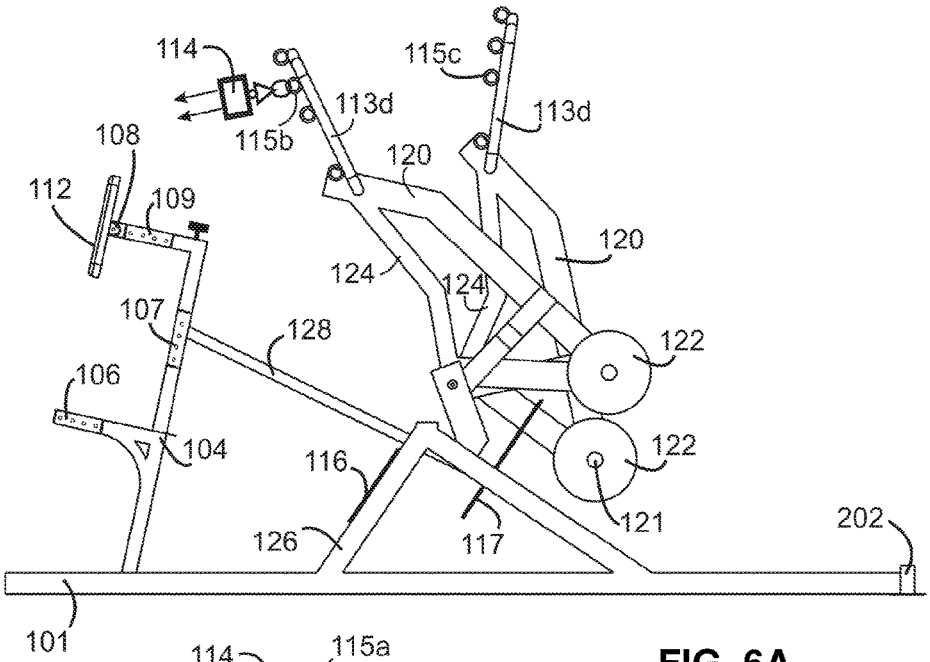
FIG. 6A is a side view of another alternative embodiment of the horizontal rowing machine constructed according to the principles of the present invention.
Figure 6B:
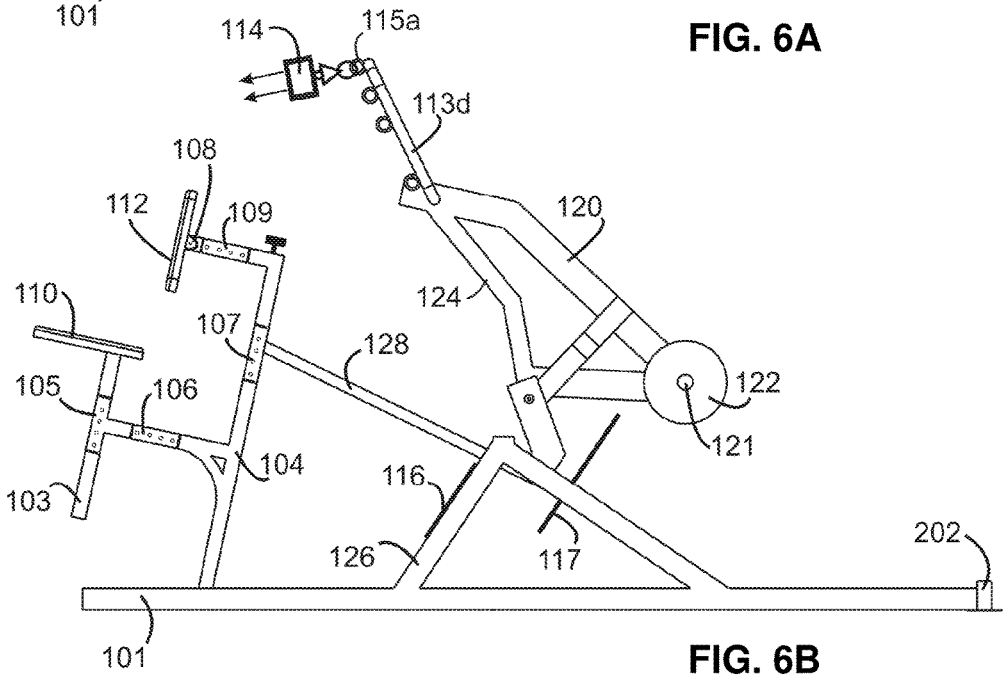
FIG. 6B is a side view of another alternative embodiment of the horizontal rowing machine constructed according to the principles of the present invention.

As shown in FIG. 4, the handles (113*a*-113*h*) are provided in a specific shape that can be held in at least 8 different fixed positions 113*a*, 113*b*, 113*c*, 113*d*, 113*e*, 113*f*, 113*g* and 113*h*. In one embodiment, each of the two handles (113*a*-113*h*) have a plurality of apertures at 6 different positions 115*a*, 115*b*, 115*c*, 115*d*, 115*e* and 115*f*. Swivel handles 114 can be mounted and fixed to the handle apertures (115*a*-115*f*) to maintain a comfortable grip during the exercise. The user's grip can easily change during the exercise when the swivel handles are moved forwards, backwards, or slightly leftwards and rightwards to create the rowing action.

The moving arms of the machine 120 are connected to the weight plate holders 121 in a manner allowing them to move upwardly by user's pulling action. The position of applied force can be changed by changing the position of the grip on the handles (113*a*-113*h*). This allows the user to work out the desired muscles.

The user can make this exercise more challenging by using resistant bands. According to FIGS. 1 and 2, again at least a pair of band hooks 123 is provided on each of the support arms of the handle 124 for adding more weight to the exercise. This enables the user to workout with resistance bands alone when pulling on the handles (113*a*-113*h*), which will provide dynamic resistance that is exponential in nature. Further, this elastic resistance may be used in combination with weight plates 122. Adding the elastic bands allows for maximal muscular contraction throughout the entire range of each repetition.

The present invention includes foot plates 116, 117 to provide a foot receiving surface. The foot plates are arranged so that the user can also operate the machine while standing and with the right foot or the left foot thereon. One pair of foot plates 116 are mounted with an angle on the outer support beams of the frame 126 to enable the user to perform the machine with either the right or the left foot. The second pair of foot plates 117 is mounted with an angle on the middle support beam of the frame 127 to enable the user to perform the machine with both feet. The user can operate the rowing exercise only with the right or the left hand, or with the right or the left foot, or with both hands and feet. The user can also operate the machine in a seated position or standing position by removing the seat.

In order to perform a rowing exercise using the present invention, the user can be seated on the seat, with both feet resting on the foot plates while holding the handles securely. As the handles are pulled back, simultaneously or one at a time, the moving arms rotate around the axis point facilitating the weight plates (resistance) to move by the force created by the user. The resistance 122 moves from a rest position upwardly against the gravity to an upper position. When the user has completed the lifting stroke, the resistance returns to its rest position.

Different methods of operation of the machine are shown in FIGS. 5A, 5B and 6A, 6B. In one method, the user sits on the seat 110 facing forward and grabs the handles (113*a*-113*h*) or the swivel handles 114. Then, the user places his/her feet on the foot plate 117, and pulls the handles toward his/her body, while leaning on the chest pad 112. The user can change the grip position to train different muscles. During the pulling action, the upper back and arm muscles are primarily used to pull the handles 114 toward the user's chest. The angles of elbows are naturally changed to pull up the weight plates 122. This state is maintained for several seconds after the pulling operation to allow the muscles to be sufficiently contracted. Then, the force is lowered and the weights plates are moved back to their original resting position. The user's grip can easily change dynamically when the swivel handles are moved forward, backward, or slightly leftward and rightward to create the rowing action.

The rowing operations are repeatedly carried out creating the stimulus to obtain the desired muscular adaptation from this rowing exercise. Through the above-mentioned exercise, the user can build his/her upper body muscles, especially, the muscles of the upper back and front of the arms. The handles (113*a*-113*h*) are arranged in a manner to be grasped by the user and moved along a guided path resisted by the machine 10. Since the chest pad has a swivel mechanism, the upper body of the user can rotate in various angles while performing the exercise.

In another embodiment, the seat can be removed to perform the rowing exercise while standing. The user can perform the exercise while standing with the right foot on the foot plate 116 and pull the right handle (113*a*-113*h*) or swivel handle. The user can also perform the exercise while standing with the left foot on the foot plate on the left side of the rowing machine while holding the left side handle.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regards to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A horizontal rowing machine comprising:

a) a frame having a right and a left longitudinally extended beams, a set of cross beams to stably support said rowing machine;

b) a pair of lever arms, wherein said lever arms are substantially vertical at their rest position, and each said lever arm has a moveable proximal end on its upper side, a movable distal end on its lower side, and a fixed lever point in between the proximal and distal end, each said lever arm has a closed polygonal shape, wherein said lever point is pivotally connected to said frame, whereby each said lever arm pivots on a single-vertical-plane;

c) a handle attached to said proximal end of each said lever arm to be grabbed and pulled by a user, whereby said handle moves in a vertical and non-diverging plane keeping the user's hand movement in a vertical plane;

d) a weight plate holder attached to said distal end of each said level arm to resist a pulling action of the user;

e) an adjustable seat removably attached to said frame at a predefined longitudinal distance from said lever arms, and wherein said seat is adjustable to allow the user's arm to be substantially horizontal when grabbing each said handle;

f) an adjustable chest pad attached to said frame and located in between said seat and said lever arms to support the user's body during the releasing action of said lever arms;

g) a pair of foot plates mounted at an angle to said frame to help in the pulling and releasing actions of said lever arms, whereby the user sits on the adjustable seat with user's chest against the chest pad and user's foot on the foot pads, grabs the handles performs pulling and releasing of the lever arms, mimicking a rowing action.

2. The horizontal rowing machine of claim 1, wherein each said lever arm is a five sided concave polygon, wherein the lever point is on a first corner of the polygon, the handle is attached to a third corner of the polygon, and the weight plate holder is attached to a fifth corner of the polygon, and wherein a second corner of the polygon is located such that the first and the third corners make a concave side of the polygon, and wherein the angles of said polygon, relative to the horizontal, move to provide a substantially horizontal movement to the handle during a pivoting action of said lever arm around the first corner.

3. The horizontal rowing machine of claim 1, wherein said each said lever arm is independently attached to said base frame, thereby, each said lever moves independently of the other lever.

4. The horizontal rowing machine of claim 1, wherein said adjustable seat is adjustable in both vertical direction to adjust for the height of the user, and adjustable in the horizontal direction to adjust for the arm length of the user, whereby the user's arm are in a fully extended and horizontal direction when grabbing said handles.

5. The horizontal rowing machine of claim 1, wherein said adjustable chest pad has a swivel hinge to swivel about a pad-axis during the exercise to provide a comfortable rowing exercise and support for said user's upper body.

6. The horizontal rowing machine of claim 1, wherein said adjustable chest pad is adjustable horizontally to move the chest pad closer or farther away from said level harms according to the user's arm length.

7. The horizontal rowing machine of claim 1, wherein said adjustable chest pad is adjustable vertically to align the chest pad with the users' chest.

8. The horizontal rowing machine of claim 1, further having a set of weight plates to be placed on said weight plate holder.

9. The horizontal rowing machine of claim 8, wherein said weight plate holder fits at least 8 standard 45 pound plates.

10. The horizontal rowing machine of claim 1, further having a pair of band hook holders attached to said frame at a fixed location, whereby a band hook is attached between each said band hook holder and each said weight plate holder, whereby each said band hook extends during the pulling action increasing resistance to the exercise, and whereby said resistance increases the further the handles are pulled.

11. The horizontal rowing machine of claim 1, further having a pair of swivel-handles for a swivel movement of the handle, wherein each said swivel-handle can be attached to a plurality of apertures on each said handle, whereby the user can perform the exercise using the swivel-handles instead of said handles in order to adjust the user's distance to the level arms.

12. The horizontal rowing machine of claim 1, wherein each said handle is C- or G-shaped to provide a plurality of grabbing areas.

13. The horizontal rowing machine of claim 1, wherein each said handle has extended horizontal and vertical sections to provide a plurality of options for holding said handle.

14. The horizontal rowing machine of claim 1, further having a pair of second foot plates, wherein said second foot plates are mounted with an angle to a medial beam that is connected to said base frame, wherein each said second foot plate is horizontally aligned with each said lever arm to allow the user to perform the horizontal rowing exercise with one hand and while standing.

15. The horizontal rowing machine of claim 1, further having a set of acute angled beams having a height and being vertically attached to said set of cross beams, to raise the height of each said lever point above a base ground level.

* * * * *